US009816495B2

(12) United States Patent
Aiken

(10) Patent No.: US 9,816,495 B2
(45) Date of Patent: Nov. 14, 2017

(54) PRESSURIZED FLUID DELIVERY SYSTEM

(71) Applicant: Duane Aiken, Brevard, NC (US)

(72) Inventor: Duane Aiken, Brevard, NC (US)

( * ) Notice: Subject to any disclaimer, the term of this patent is extended or adjusted under 35 U.S.C. 154(b) by 0 days.

(21) Appl. No.: 14/980,878

(22) Filed: Dec. 28, 2015

(65) Prior Publication Data

US 2016/0208786 A1 Jul. 21, 2016

Related U.S. Application Data

(60) Provisional application No. 62/105,945, filed on Jan. 21, 2015.

(51) Int. Cl.
*F04B 13/00* (2006.01)
*F04B 15/02* (2006.01)
*F04B 53/18* (2006.01)

(52) U.S. Cl.
CPC ..... *F04B 13/00* (2013.01); *F04B 15/02* (2013.01); *F04B 53/18* (2013.01)

(58) Field of Classification Search
CPC ..... F04B 13/00; F04B 53/18; F04B 15/02
USPC ..... 222/318, 333, 608
See application file for complete search history.

(56) References Cited

U.S. PATENT DOCUMENTS 2,314,051 A 3/1943 Osgood
2,870,737 A 1/1959 Byrnes
2,992,928 A 7/1961 Magnuson
4,393,957 A 7/1983 Hawthorne
4,949,070 A 8/1990 Wetzel
5,167,348 A 12/1992 Okami et al.
5,178,302 A 1/1993 Cheng
5,285,871 A * 2/1994 Sievenpiper ..... F16N 11/10 184/29
5,395,447 A 3/1995 Wu
5,531,085 A * 7/1996 Hayes ..... B21J 3/00 72/20.1
6,003,635 A 12/1999 Bantz
6,382,128 B1 5/2002 Colson
6,821,345 B2 11/2004 Obermark
7,935,390 B2 5/2011 Muljono
8,109,455 B2 2/2012 Allen
2003/0080161 A1* 5/2003 Burger ..... B67D 7/845 222/608
2009/0045216 A1* 2/2009 Mamaghani ..... G01F 11/00 222/1
2012/0145484 A1* 6/2012 Fassbinder ..... F16N 7/38 184/26
2016/0186740 A1* 6/2016 Klaphake ..... F04B 17/03 417/45
2016/0207090 A1 7/2016 Aiken
2016/0208786 A1 7/2016 Aiken

OTHER PUBLICATIONS

Non-Final Office Action for Utility U.S. Appl. No. 14/980,841 dated Mar. 1, 2017 (11 pages).

* cited by examiner

*Primary Examiner* — Donnell Long
(74) *Attorney, Agent, or Firm* — Thrive IP; Bernard S. Klosowski

(57) ABSTRACT

Systems and methods are provided for delivering fluid under pressure, the fluid feed being independently controlled.

8 Claims, 7 Drawing Sheets

SECTION A-A

PRESSURIZED FLUID DELIVERY SYSTEM

CROSS-REFERENCE TO RELATED APPLICATIONS

This application claims benefit of U.S. Provisional Patent Application Ser. No. 62/105,945, filed in the United States Patent and Trademark Office on Jan. 21, 2015, which is incorporated herein by reference in its entirety.

BACKGROUND OF THE DISCLOSURE

Fluid supply systems are used to deliver lubricants during infeeding of stock material, such as strip metals, to stamping presses and dies. More particularly, pressurized fluid delivery systems are preferred for precise control of lubricant deposits relative to volume and timing in a press cycle. Pressurized fluid delivery systems can deliver lubricants in graduated amounts to suitable applicators such as spray nozzles or rollers that interface with the process material.

A common type of fluid delivery system features pneumatically operated, positive displacement pumps. Fluid is drawn into individual pumps then, by actuation of a control valve, pistons force the lubricant from the pumps into supply lines and to the applicators. This known system suffers from at least two drawbacks. First, the only way of adjusting a dispense volume is by mechanical adjustment of individual pump strokes. These adjustments typically are not graduated, so an operator or user repeatedly must fire and observe each deposit for each pump. Not only is this manual procedure time consuming, it wastes lubricant and must be repeated each time a job is setup.

For example, if the operator is using a roller applicator at the infeeding of the strip material, it is sometimes desirable to have a thicker lubrication deposit on an underside of the strip rather than on top. This helps prevent "slug pulling" or "flipping"—a condition in which "slugs" (the portion of the strip being cut away) adheres to a "punch" (a male cutting die), which causing it to be drawn back out of the "die" (the female cutting die). When this condition occurs, it can create feeding problems and/or undesirable indentions in the material production part. Applying more lubrication on the bottom of the material and less on top helps combat this condition while keeping the die adequately lubricated. In this case, timing may not be as important, but differential distribution is critical. However, achieving such differential distribution is extremely difficult with systems that require mechanical adjustment of individual pump strokes.

A second drawback with typical pressurized fluid delivery systems is the existence of a single timing signal. Such a system fires all pumps at once, which may be undesirable. One processing goal, for example, is to use the least amount of lubricant as possible while evenly distributing the lubricant. An accepted way of accomplishing this goal is to spray the lubricant while the strip is advancing. However, if the user needed subsequent nozzles to reapply lubricant at certain intervals throughout the stamping process, this would likely be done while the strip is at rest. With only a single timing signal from the press, the timing would be set for the subsequent nozzles. The nozzle at the infeed would then spray on the strip while at rest and leave a puddle of lubricant rather than an even film of lubricant.

Although some existing systems have independent controls for individual outlets being served by a pressurized supply, their pressure source is a pneumatically operated diaphragm pump. Pneumatically operated pumps typically consume a significant amount of compressed air, and their compressed air generation is approximately only 15% efficient. Moreover, known compressed air systems require multiple power sources to operate associated equipment (e.g., requiring both electricity and compressed air).

Although all-electric pumps also have been used for fluid delivery, such systems utilize a continuously running delivery in which the only way of regulating fluid delivery is by using metering valves to restrict flow. This has a number of disadvantages. First, precise control of lubricants is not possible with continuously running systems. Second, constant pumping of fluid under pressure tends to heat the lubricant, which may be undesirable due to changed handling and make-up characteristics of the heated lubricant. Third, at no time is a lubricant not being applied in a continuously running delivery. Therefore, if connected to a spray nozzle, a continuously running system creates substantial waste and consequently, housekeeping issues due to the spillage.

What is needed in the industry is a portable pressurized fluid delivery system that provides process operators complete control of lubricant deposits; that can be used with multiple types of applicator devices; and that can store settings used with ancillary equipment in a different process setups.

BRIEF SUMMARY OF THE DISCLOSURE

The present disclosure is directed in general to a pressurized fluid delivery system in which an operator or user fully controls a lubricant deposit and the volume and timing control for each applicator. No compressed air is required and only a single power source is needed. The inventions of the disclosure make it possible to store all fluid settings with those of ancillary equipment used in a press setup.

In an embodiment according to the present disclosure, a pressurized fluid delivery system may include a pump enclosure having an accumulator; a portable fluid reservoir; a base assembly; and means for delivering fluid from the fluid reservoir to a fluid applicator. The accumulator can receive and hold fluid under pressure, and a manifold may be provided for independent fluid delivery to an external system. The system may be electrically powered, and volume and timing may be independently controlled. Fluid settings can be stored with settings of ancillary equipment used in a press setup.

In another aspect, an electric pressurized fluid delivery system for application of lubrication in a stamping or similar process is provided.

In yet another aspect of the disclosure, a dispensing system has infinite timing control that can be adjusted and stored in a suitable press controller.

Additional objects and advantages of the present subject matter are set forth in, or will be apparent to, those of ordinary skill in the art from the description herein. Also, it should be further appreciated that modifications and variations to the specifically illustrated, referenced, and discussed features, processes, and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of the various embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE DISCLOSURE

Figure 1:
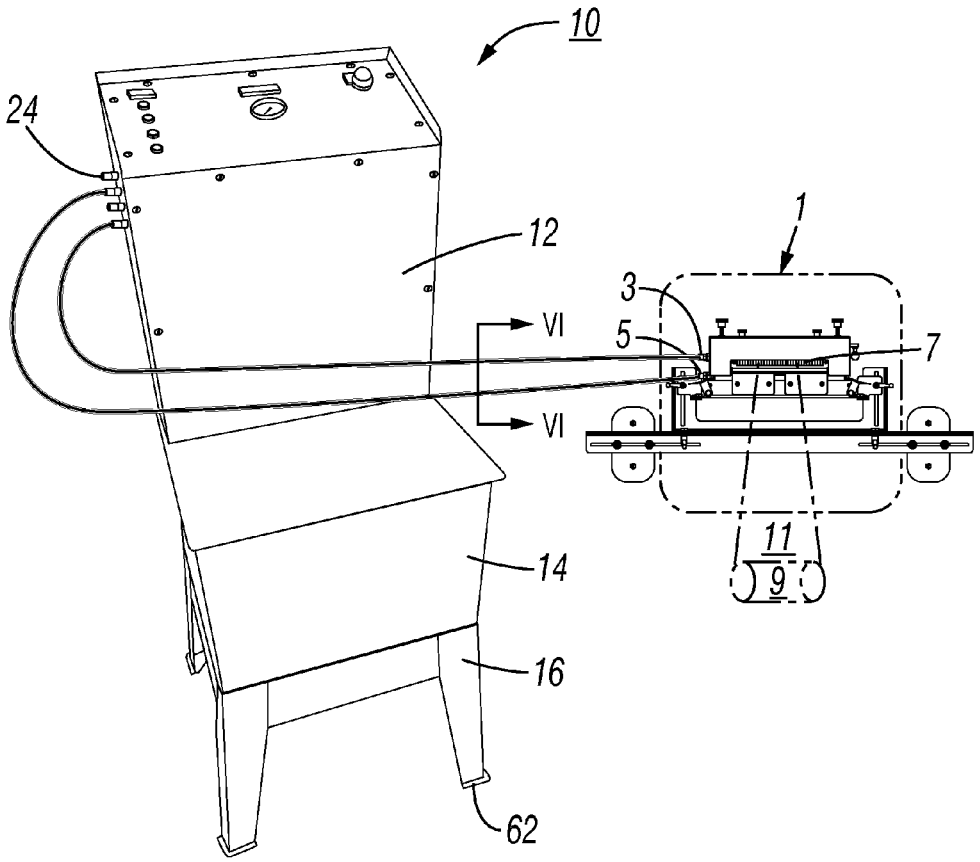
FIG. 1 is a perspective view of a pressurized fluid delivery system connected to a roller lubricator system (shown schematically) in an intended use environment according to an aspect of the present disclosure.

In general, the present disclosure provides systems and methods for improving operations and functionality of applicator devices during treatment of stock metal strips before the stock enters a stamping press or similar production line. The systems are economical to make and use.

Detailed reference will now be made to the drawings in which examples embodying the present subject matter are shown. The drawings and detailed description provide a full and written description of the present subject matter, and of the manner and process of making and using various exemplary embodiments, so as to enable one skilled in the pertinent art to make and use them, as well as the best mode of carrying out the exemplary embodiments. However, the examples set forth in the drawings and detailed descriptions are provided by way of explanation only and are not meant as limitations of the disclosure. The present subject matter thus includes any modifications and variations of the following examples as come within the scope of the appended claims and their equivalents. The detailed description uses numerical and letter designations to refer to features of the drawings.

Figure 2:
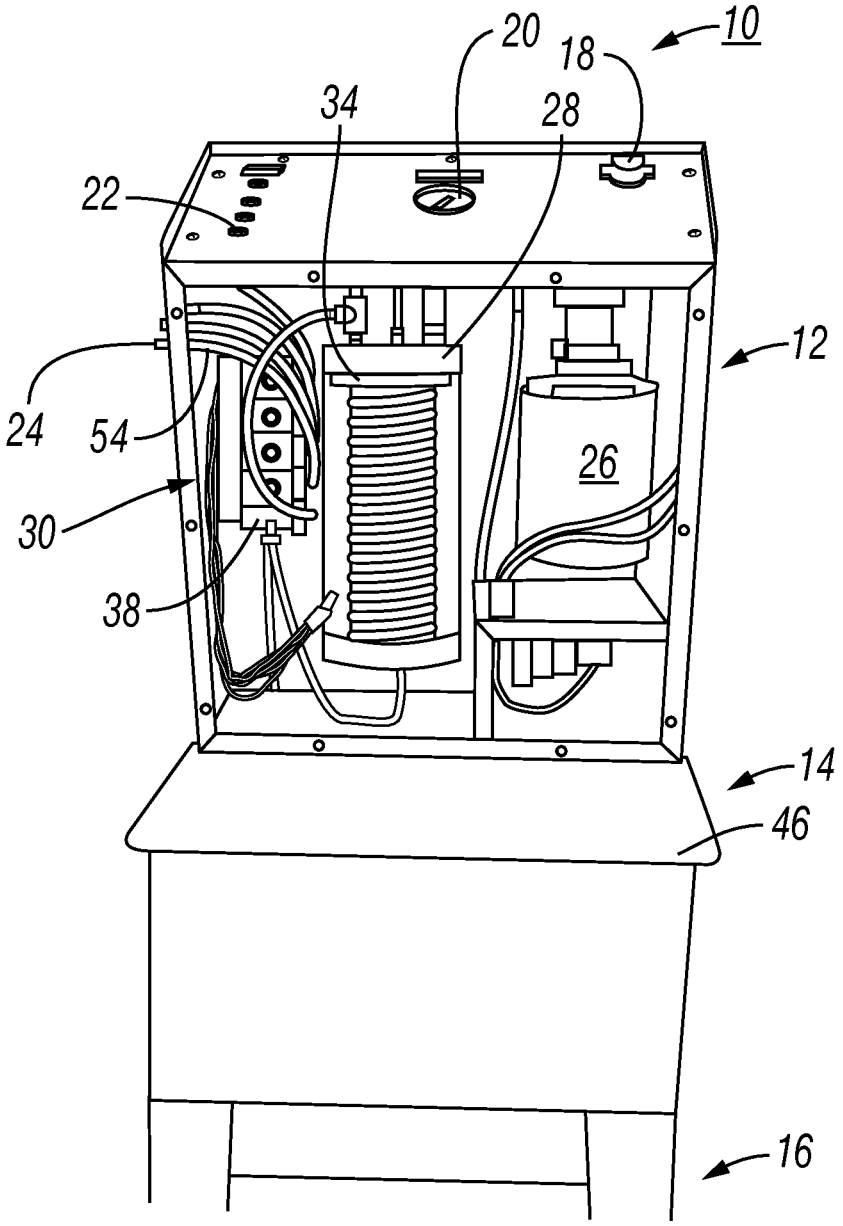
FIG. 2 is a partial, perspective view of the pressurized fluid delivery system as in FIG. 1.

Turning now to the figures, FIGS. 1 and 2 show a pressurized fluid or lubricant delivery system, designated in general by the numeral 10, arranged next to and connected or attached to a quick release or applicator lubricator system 1. As shown, the lubricator system 1 is operably connected to a press or stamping machine (not shown). A preferred lubricator system 1 is available from Automated Tool and Machine, Inc. of Brevard, N.C., USA.

As shown in the embodiment in FIGS. 1 and 2, the exemplary pressurized fluid delivery system 10 broadly includes a pump or enclosure assembly 12, a fluid container, reservoir, or tank assembly 14, and a base assembly, carrier or portable stand 16. By way of brief introduction, a process material such as stock metal in coil form 9 may be unrolled as a sheet 11 into the roller lubricator system 1. In this example, the tank assembly 14 provides a fluid such as a lubricant to rollers 7 in the roller lubricator system 1. The rollers 7 apply the lubrication fluid to a surface of the metal 11, and the metal 11 proceeds downstream in a production line where the lubricated metal 11 is stamped, cut or the like.

FIG. 2 particularly shows a system power switch or selector 18 of the enclosure assembly 12. Once the pressurized fluid delivery system 10 is in position—for instance, by rolling it on wheels under legs 62—connected to an electric power supply, and operably connected to the lubricator system 1, the fluid delivery system 10 can be activated by turning on the selector 18. Thus, lubricant can be drawn from the tank assembly 14, which in this example holds approximately fifteen (15) gallons and includes a foldable or retractable lid or cover 46. Also shown, a pressure gauge 20, LED indicator or the like indicates pressure in the system 10, and purge pushbuttons 22 are provided for one-push purge of the lines 54 leading to the connections 24.

Also shown in FIG. 2, an electric motor driven pump 26 delivers fluid from the reservoir 14 to a pressure storage vessel, accumulator or valve assembly 28, which is connected to a manifold 30. The valve assembly 28 has an accumulator cylinder 32, which may be constructed of a clear, acrylic material capable of withstanding corrosives chemicals and distillates in order to monitor a piston 34 and a spring 36 within the cylinder 32. The piston 34 may be constructed of ultra high molecular weight (UHMW) polyethylene material, which has superior chemical, fatigue and wear resistance attributes. As shown, an upward mechanical spring constant in this example will oppose downward fluid pressure as the pump 26 delivers fluid into the accumulator cylinder 32 and from there to the manifold 30 for independent fluid delivery to external systems such as the lubricator system 1. Although a spring accumulator is shown in this example, a pneumatic chamber may be used instead of, or in addition to, the spring 36 such that air pressure in the pneumatic chamber can oppose or resist the fluid pressure.

More specifically, by way of example operation, pressure from the pump 26 in FIG. 2 overcomes a mechanical resistance to allow a volume of fluid to be held in the accumulator 32. A separation between the fluid volume and the mechanical force exists as the piston 34 that travels within, and is sealed to, the cylinder 32. As noted above, such mechanical resistance can be provided by spring force, a pneumatic precharge or the deflection of an elastomer.

A pressure indication from the fluid chamber of the accumulator 32 turns off the pump motor 26 when a setpoint is reached. A check valve between the pump 26 and the accumulator 32 prevents backfeeding through the pump while the motor 26 is off. The contents of the accumulator 32 are held under pressure until dispensed or evacuated.

From the accumulator 32, the fluid is fed to the valve manifold 30. As introduced briefly above, a plurality of solenoid operated valves 38 engage the manifold 30 and provide a controlled outlet for the fluid. These valves 38 are operated by a controller having a programmed configuration for timing and sequencing in relation to a press cycle.

Figure 3:
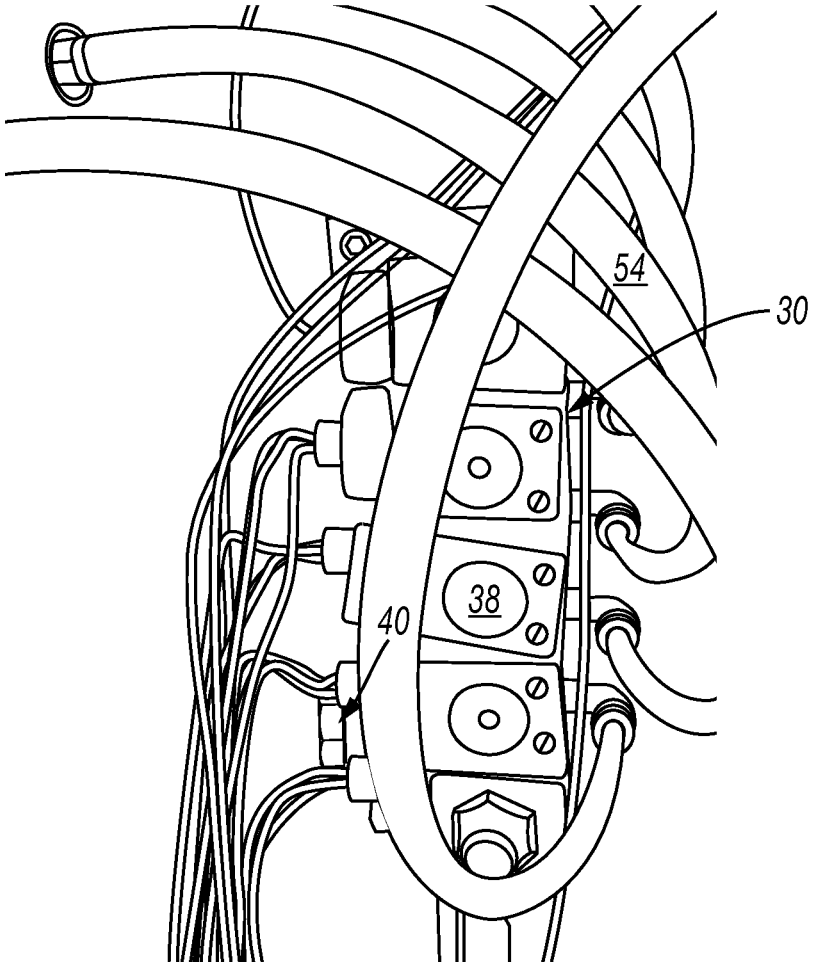
FIG. 3 is a partial, elevational view of a manifold of the pressurized fluid delivery system as in FIG. 1.
Figure 4:
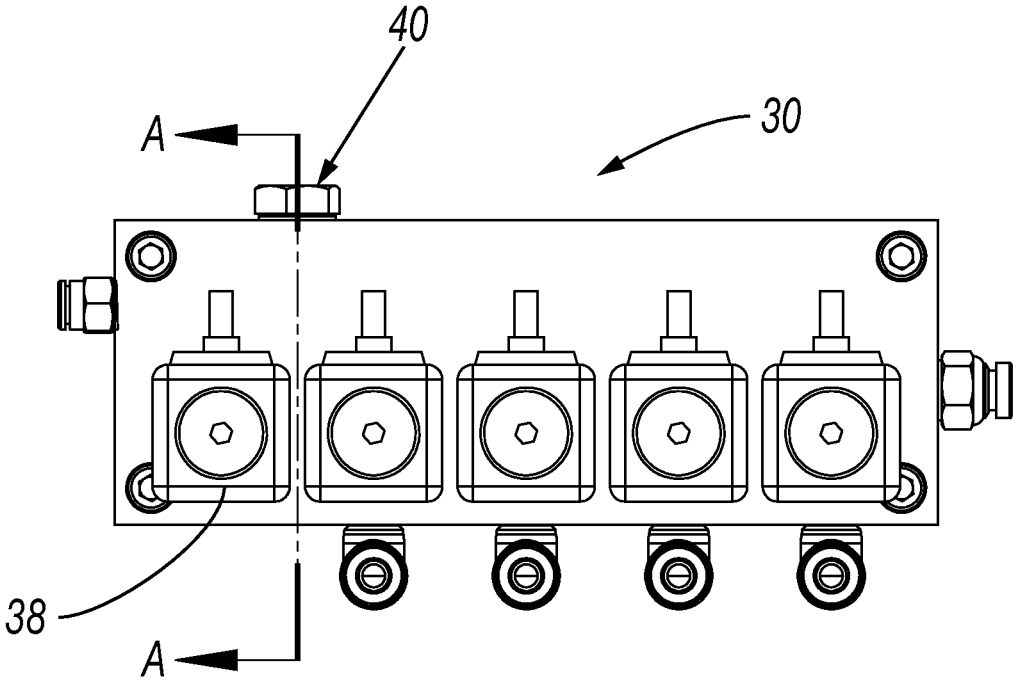
FIG. 4 is a schematic view of a manifold of the pressurized fluid delivery system as in FIG. 3 and a cross-sectional view of a ball relief valve taken along lines A-A of the manifold according to another aspect of the disclosure.
Figure 4:
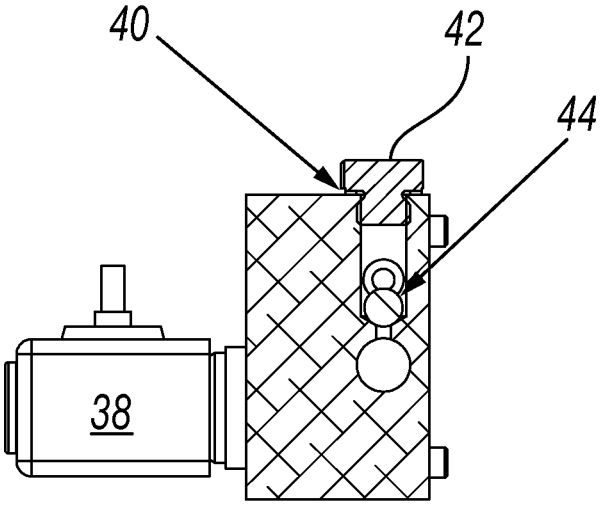

As shown most clearly in FIGS. 3 and 4, a safety feature such as a relief valve or ball safety valve 40 is provided in the manifold 30 to permit release of excess fluid pressure to prevent rupture of the valve assembly 28, particularly the accumulator cylinder 32, should the pressure switch fail. As shown in cross-section, the safety valve 40 includes a sealing washer 42 and a ball 44. Additionally, a reverse operating solenoid valve releases all fluid back to the tank assembly 14 through lines 54 when the system 10 is switched off.

Figure 5:
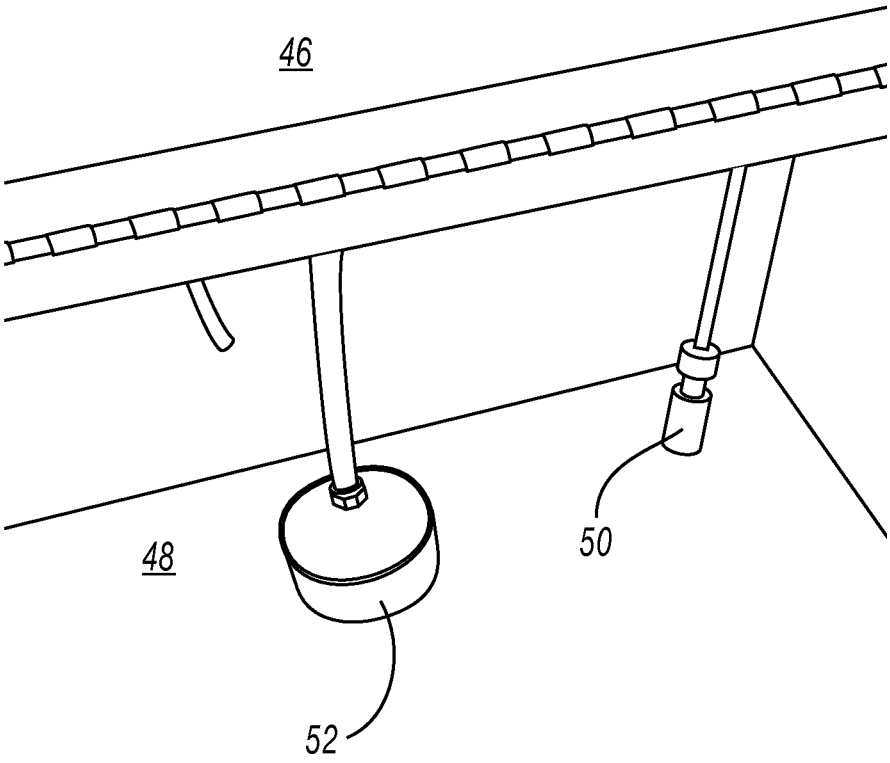
FIG. 5 is a perspective view of a lubricant compartment of the pressurized fluid delivery system as in FIG. 1.

Turning to FIG. 5, the cover 46 of the tank assembly 14 (see FIG. 1) is opened or retracted to reveal an interior compartment or reservoir 48 for holding a lubricant. In this example, the compartment 48 is stainless steel and includes a float switch or ball valve 50 to indicate a low level of fluid. If activated, the pump motor 26 (see FIG. 2) is switched off, and optionally, a signal sent to the machine controller to stop the operation and alert the operator. Also shown in the compartment 48 is a strainer or strain assembly 52 to strain contaminants or particulates from the fluid before entering the accumulator 32 (see FIG. 2).

Figure 6:
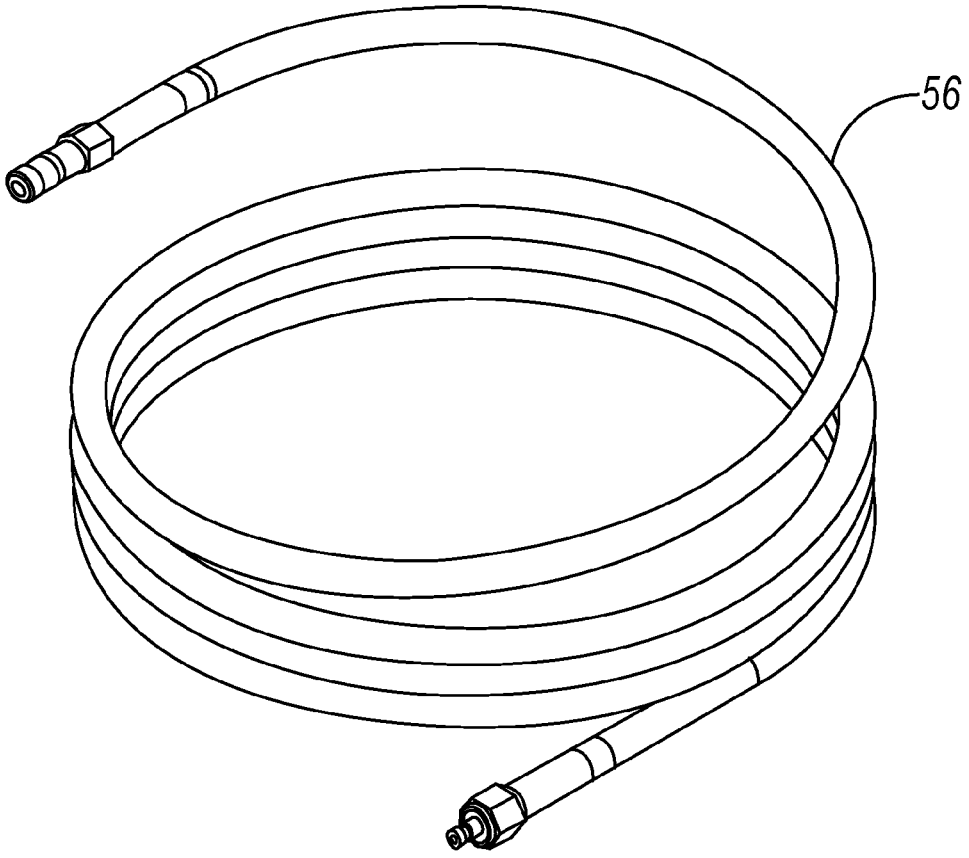
FIG. 6 includes perspective and cross-sectional views (taken along line VII-VII in FIG. 1) of a fluid delivery hose that may be used with the pressurized fluid delivery system as in FIG. 1 according to another aspect of the disclosure.
Figure 6:
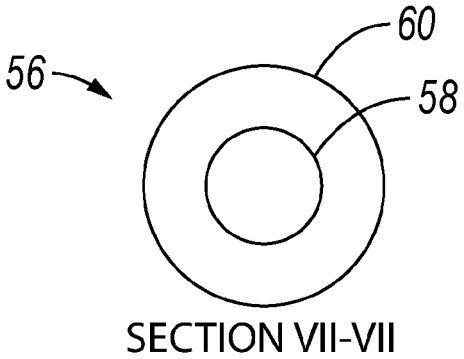

FIG. 6 shows an exemplary fluid delivery hose assembly 56. Shown in cross section from FIG. 1, the hose assembly 56 includes an inner composite pipe or tube 58 with rigid walls and an outer tube 60. In this example, the inner composite tube 58 is approximately ⅛ inch in diameter; however, such a tube alone weighs relatively little and will move more under pressure loading from fluid flow. Tube movement may damage a hose and cause leaks and increase the risk of harm to personnel if the tube moves into a walkway. Stated another way, as diameter decreases in order to achieve a better dispense, pressure rating increases, and there is more tube movement. Therefore, the outer tube 60 surrounds the necessarily smaller inner tube 58 to reduce movement or flopping and to achieve a better or more precise fluid dispense. A preferred tube 60 is available from Automated Tool and Machine, Inc. of Brevard, N.C., USA.

Figure 7:
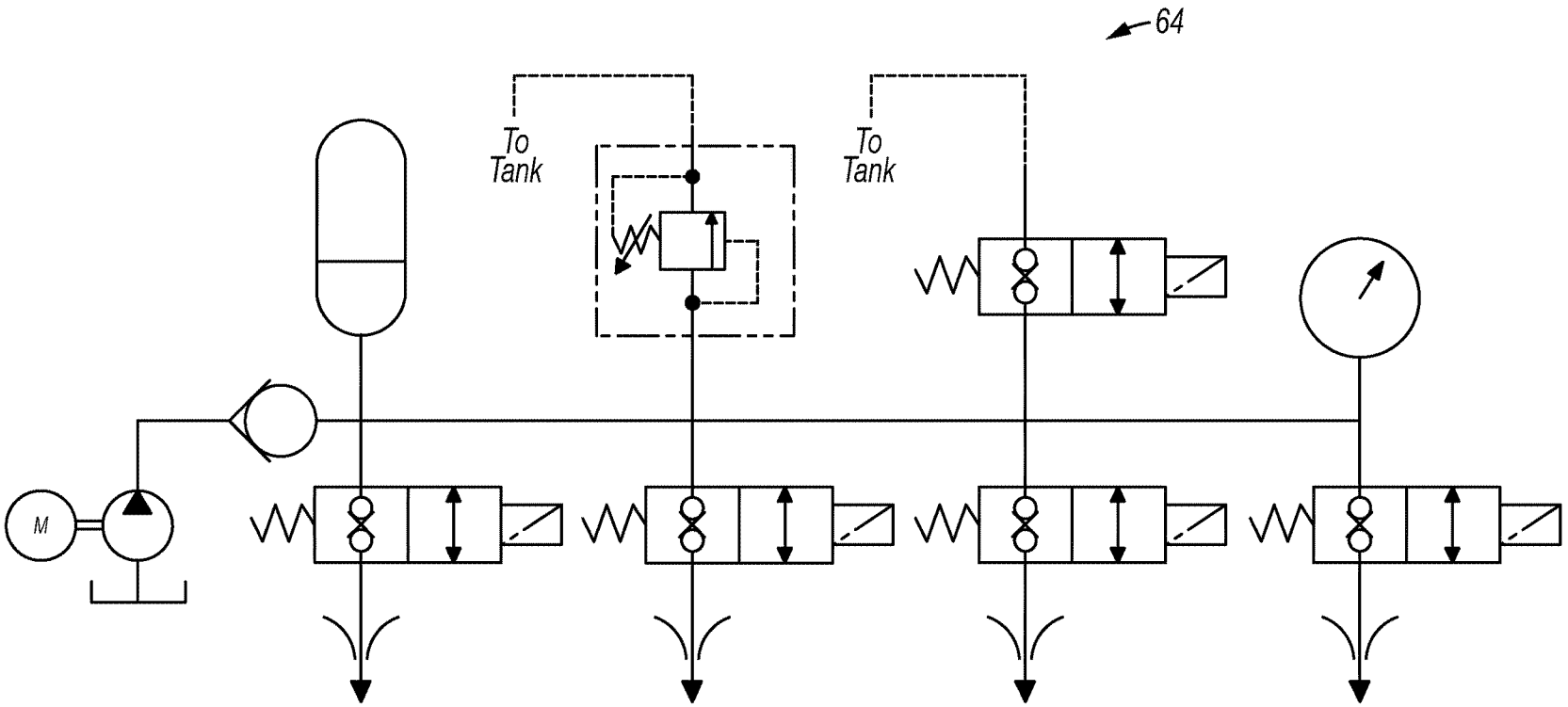
FIG. 7 is a schematic view of a hydraulic circuit of the pressurized fluid delivery system according to an aspect of the disclosure.

FIG. 7 schematically shows a hydraulic circuit 64 applicable to a pressurized fluid delivery system of the present disclosure such as the pressurized fluid delivery system 10 shown in FIG. 1.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

That which is claimed is:

1. A pressurized fluid delivery system, comprising:

a pump enclosure having an accumulator configured to hold fluid under pressure;

a portable fluid reservoir disposed in the pump enclosure;

a base assembly for holding the pump enclosure; and means for delivering fluid from the fluid reservoir to a fluid applicator, wherein the means for delivering is in communication with the accumulator and is configured to pressurize and pump fluid at a selected rate and volume according to a programmed configuration for timing and sequencing in relation to a press cycle.

2. The pressurized fluid delivery system as in claim 1, wherein the means for delivering fluid includes a pump connected to a hose.

3. The pressurized fluid delivery system as in claim 1, further comprising a manifold, the manifold being configured for independent fluid delivery to an external system.

4. The pressurized fluid delivery system as in claim 1, wherein the system is electrically powered.

5. The pressurized fluid delivery system as in claim 1, wherein volume and timing are independently controlled by the programmed configuration.

6. The pressurized fluid delivery system as in claim 1, wherein fluid settings are stored with settings of ancillary equipment used in a press setup.

7. An electric, pressurized, fluid delivery system for application of lubrication in a stamping or similar process, the fluid delivery system comprising:

a pump enclosure having an accumulator and a pump disposed therein;

a portable fluid reservoir;

a base assembly for holding the pump enclosure; and a hose connected to the pump for delivering fluid from the fluid reservoir to a fluid applicator, wherein the pump is in communication with the accumulator and is configured to pressurize and pump fluid at a selected rate and volume according to a programmed configuration.

8. The fluid delivery system as in claim 7, further comprising infinite timing control that can be adjusted and stored in a press controller in communication with the system according to the programmed configuration.

* * * * *